US005788066A

United States Patent [19]

Focke et al.

[11] Patent Number: 5,788,066

[45] Date of Patent: Aug. 4, 1998

[54] HINGE-LID PACKAGE FOR CIGARETTES OR THE LIKE

[75] Inventors: Heinz Focke, Verden; Henry Buse, Visselhövede, both of Germany

[73] Assignee: Focke & Co. (GmbH & Co.), Verden, Germany

[21] Appl. No.: 754,782

[22] Filed: Nov. 21, 1996

[30] Foreign Application Priority Data

Dec. 5, 1995 [DE] Germany ..... 195 45 200.3

[51] Int. Cl.[6] ..... B65D 85/10

[52] U.S. Cl. ..... 206/298; 206/273; 229/160.1

[58] Field of Search ..... 206/242, 259, 206/265, 268, 270, 271, 273; 229/160.1

[56] References Cited

U.S. PATENT DOCUMENTS

| | | | |
|---|---|---|---|
| 1,735,325 | 11/1929 | L'Enfant | 206/265 |
| 1,877,955 | 9/1932 | Ottinger . | |
| 2,848,153 | 8/1958 | Geiger, Sr. . | |
| 2,951,626 | 9/1960 | Weiss . | |
| 2,958,418 | 11/1960 | O'Gorman | 206/273 |
| 3,207,416 | 9/1965 | Koltz et al. . | |
| 4,216,898 | 8/1980 | Davies | 206/273 |
| 4,303,191 | 12/1981 | Foster et al. | 229/160.1 |
| 4,753,383 | 6/1988 | Focke et al. | 206/273 |
| 5,314,062 | 5/1994 | Wu et al. | 206/268 |

FOREIGN PATENT DOCUMENTS

| | | |
|---|---|---|
| 0452068 | 10/1991 | European Pat. Off. . |
| 1693847 | 10/1954 | Germany . |
| 2408879 | 9/1975 | Germany . |
| 4142022 | 6/1993 | Germany . |
| 2011856 | 7/1979 | United Kingdom . |
| 2276611 | 10/1994 | United Kingdom . |
| WO9609230 | 3/1996 | WIPO . |

*Primary Examiner*—Paul T. Sewell
*Assistant Examiner*—Luan K. Bui
*Attorney, Agent, or Firm*—Abelman, Frame & Schwab

[57] ABSTRACT

Hinge-lid package with a package portion (10) and lid (11) and with a collar (23) especially for containing a cigarette block (27).

Package portion (10) and lid (11) are interconnected in the rear region of the hinge-lid package by an obliquely-extending hinge joint (58). In addition, a collar front wall (24) is provided with an oblique-angled, trapezoid aperture (28), forming an oblique collar edge (31). In correspondence with this, an upper package edge (36) is obliquely oriented.

2 Claims, 9 Drawing Sheets

HINGE-LID PACKAGE FOR CIGARETTES OR THE LIKE

DESCRIPTION

Figure 1:
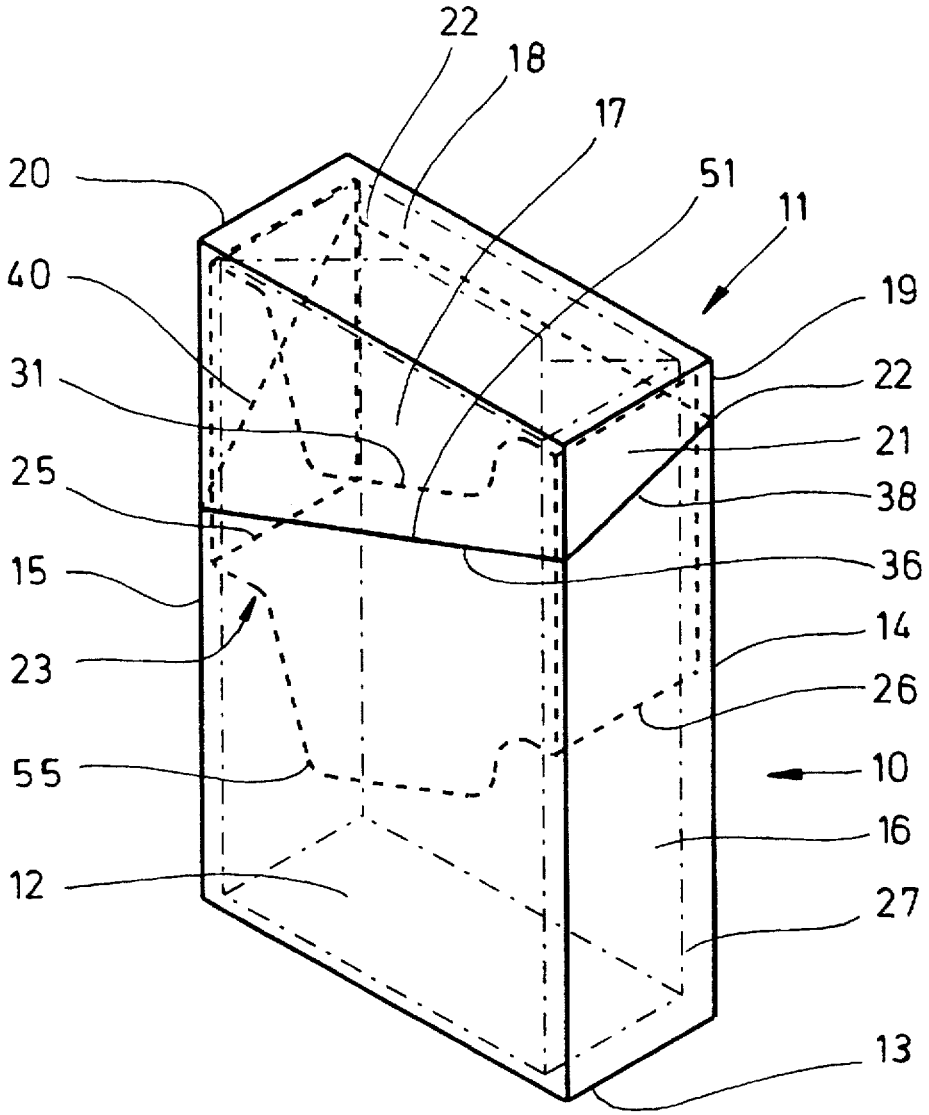

The invention relates to a hinge-lid package with a package portion and a lid flexibly connected to a package rear wall, and with a collar secured in the package portion and projecting partially therefrom, with a collar front wall and collar side tabs, particularly for containing a cigarette group (cigarette block) surrounded by an inner wrapping, the collar front wall having an upwardly-open aperture in the region above a package front wall. The invention further relates to a blank for manufacturing such a hinge-lid package.

Hinge-lid packages belong to the widely-distributed packaging types for cigarettes. The structure of the complete package normally has such an appearance that a cigarette group filling the capacity of the hinge-lid package is surrounded by an inner wrapping of paper, film or tinfoil and forms a cigarette block. This latter sits in the hinge-lid package, which is made of thin cardboard or other similar packaging material. Said hinge-lid package is surrounded by an outer wrapping of thin film. The latter is entirely or partly removed when the package is used.

In the standard previous structure of a hinge-lid package, a lid is pivotably connected to the package rear wall by a transversely-oriented hinge joint. The collar conventionally consists of a separate blank. The collar front wall is internally connected with the package front wall, especially by adhesive. Collar side tabs abut on the inner side of package side walls. An upper region of the collar, projecting out of the package portion, is surrounded by the lid when the hinge-lid package is in the closed position.

The object underlying the invention is to simplify handling of the hinge-lid package by redesigning it.

In achieving this object the hinge-lid package according to the invention is characterised in that a collar edge delimiting the aperture and adjacent to the package front wall extends obliquely in such a way that the aperture in the collar front wall has a greater height on one side than on the other side, and in that a projection of the collar front wall opposite the aperture likewise extends obliquely, in such a way that the aperture and the projection have matching geometric dimensions.

According to this feature of the invention, the aperture in the collar front wall, which is conventional in itself, has an asymmetrical, i.e. substantially trapezoid shape. In this way in particular removal of the cigarettes from the hinge-lid package in the region of greater height or greater dimensions of the aperture is simplified.

A particular feature of the invention resides in the fact that the hinge joint for connecting the lid to the package portion is likewise obliquely oriented, i.e. at an angle to the upright edges of the package. The direction of inclination of the hinge joint preferably corresponds to that of the collar edge and/or of the package edge. More appropriately, the angle of inclination of the hinge joint is however slightly smaller than that of the collar edge and/or of the package edge.

The blanks for manufacturing such a hinge-lid package, i.e. a one-piece package blank on the one hand and a separate collar blank on the other hand, are likewise formed in a special way.

Figure 2:
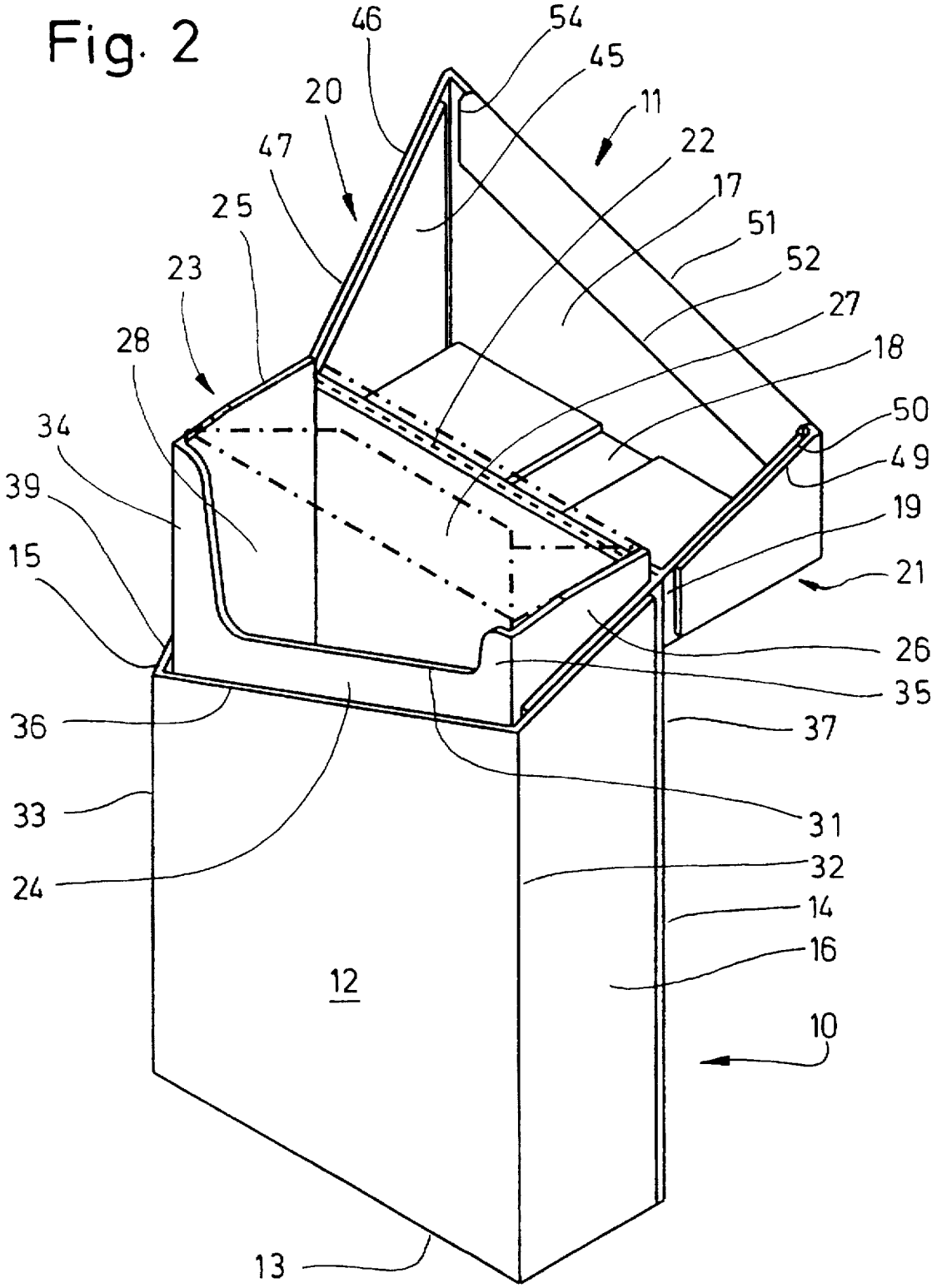
Figure 3:
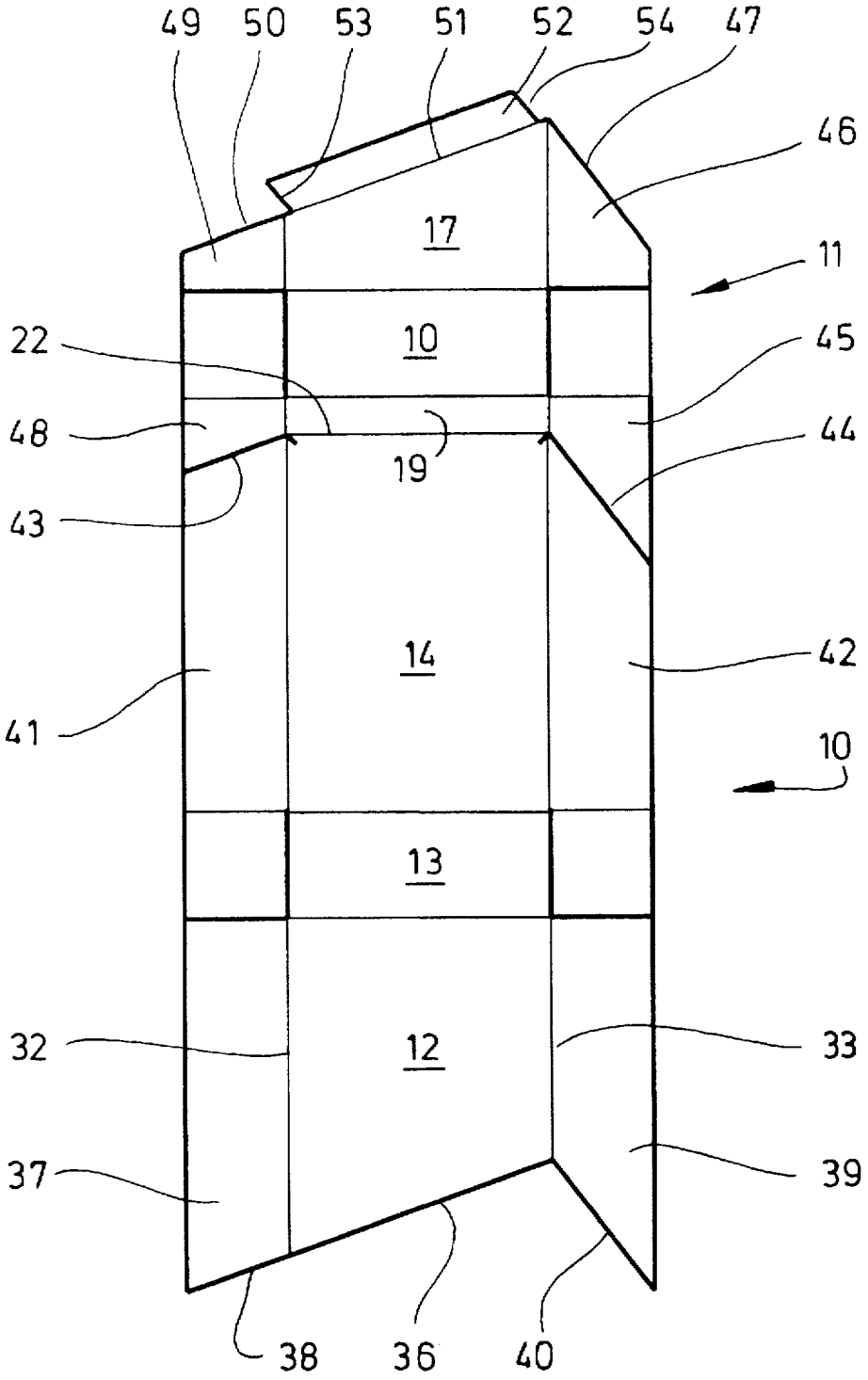
Figure 4:
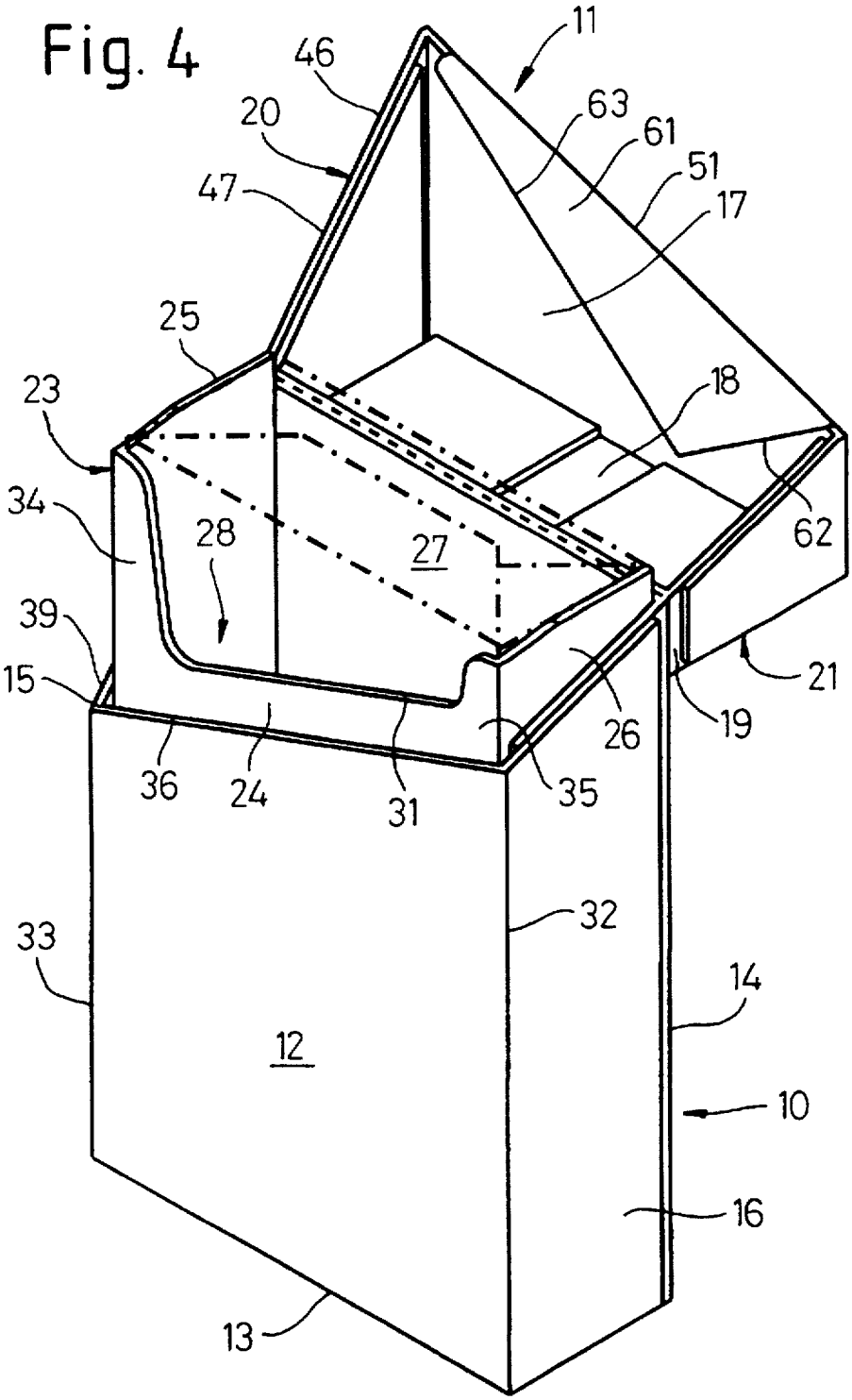
Figure 5:
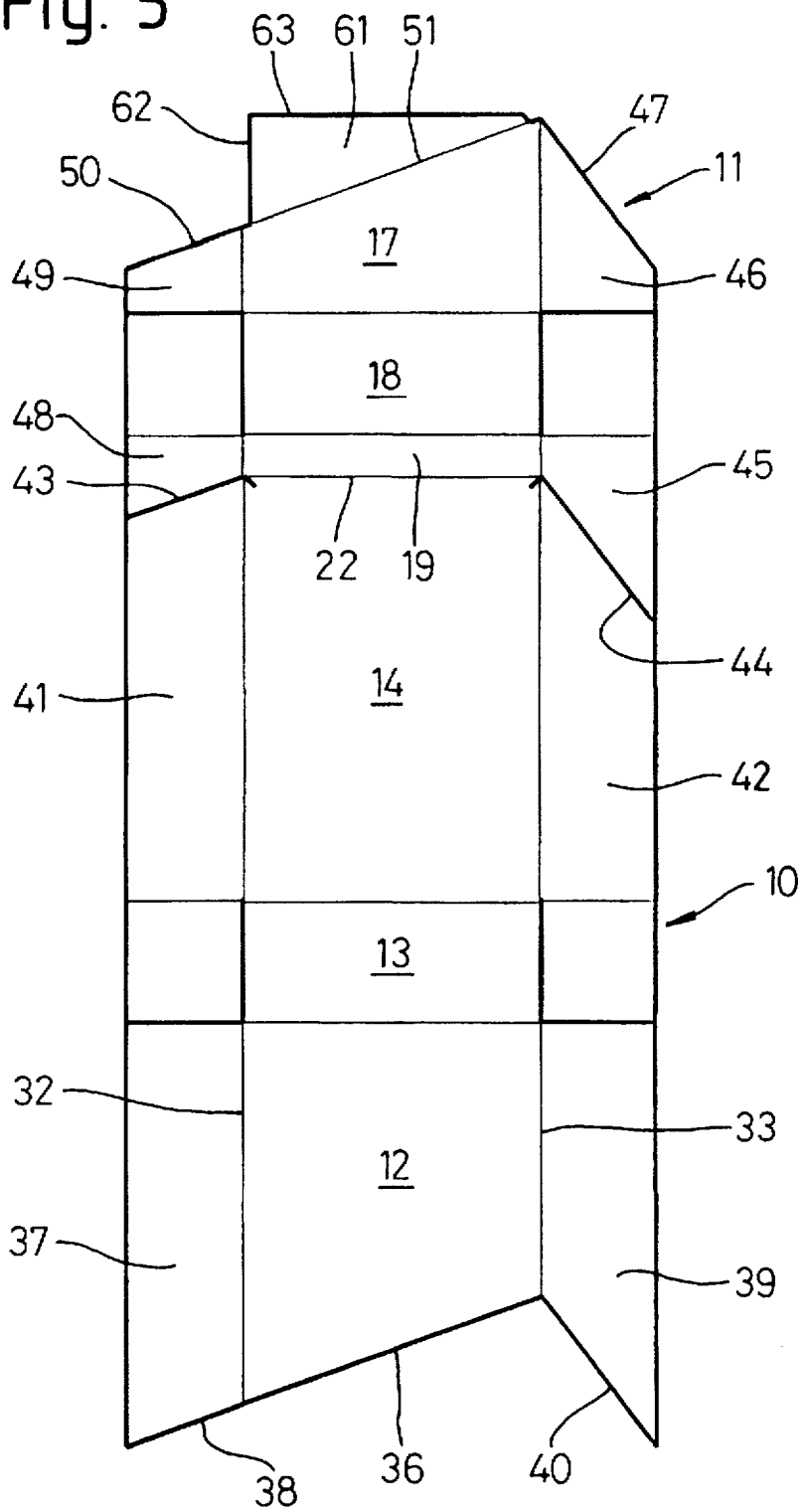

Embodiments of the hinge-lid package and of the blanks for the hinge-lid package and the collar are explained in the following with reference to the drawings, which show:

FIG. 1 a closed hinge-lid package in a perspective view,

FIG. 2 the hinge-lid package according to FIG. 1 in the open position, on an enlarged scale, FIG. 3 a spread-out, unfolded blank for the hinge-lid package according to FIG. 1, FIG. 4 a hinge-lid package according to a second embodiment of the invention, in a view corresponding to FIG. 2, FIG. 5 a spread-out, unfolded blank for the hinge-lid package according to FIG. 4

Figure 6:
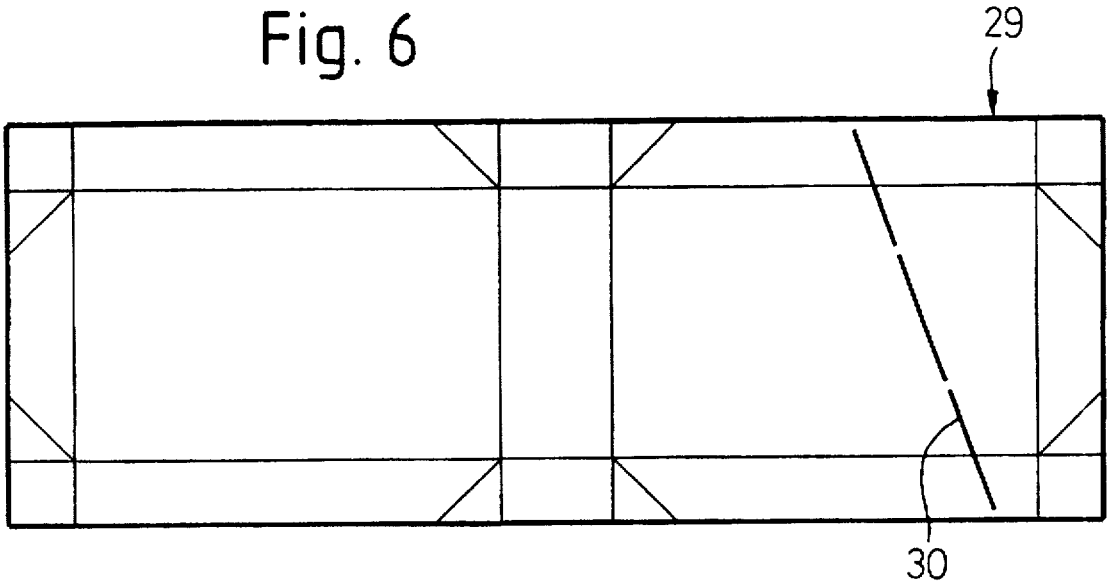
Figure 7:
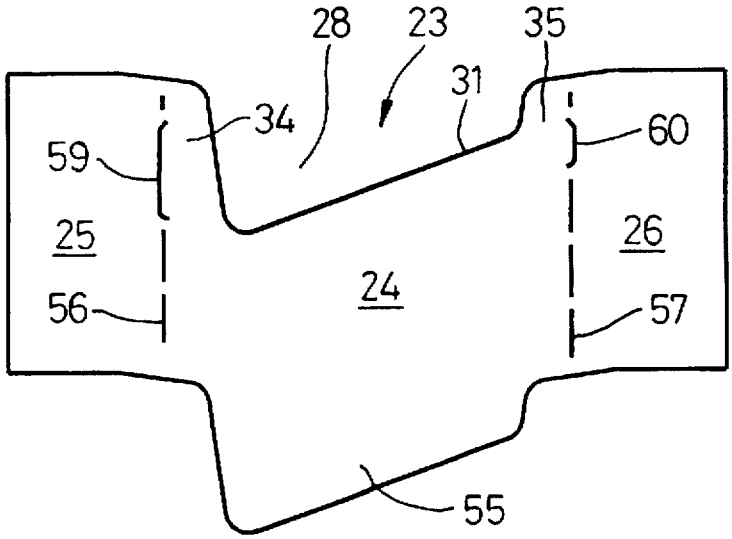
Figure 8:
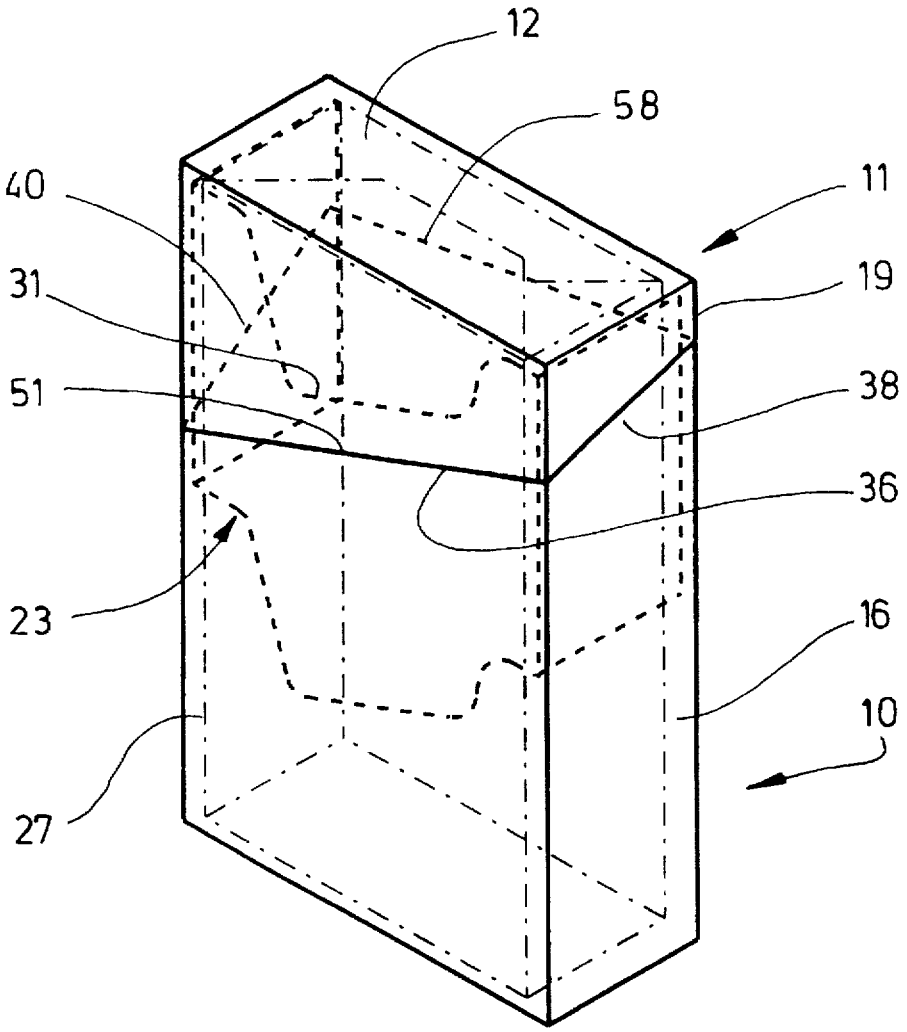
Figure 9:
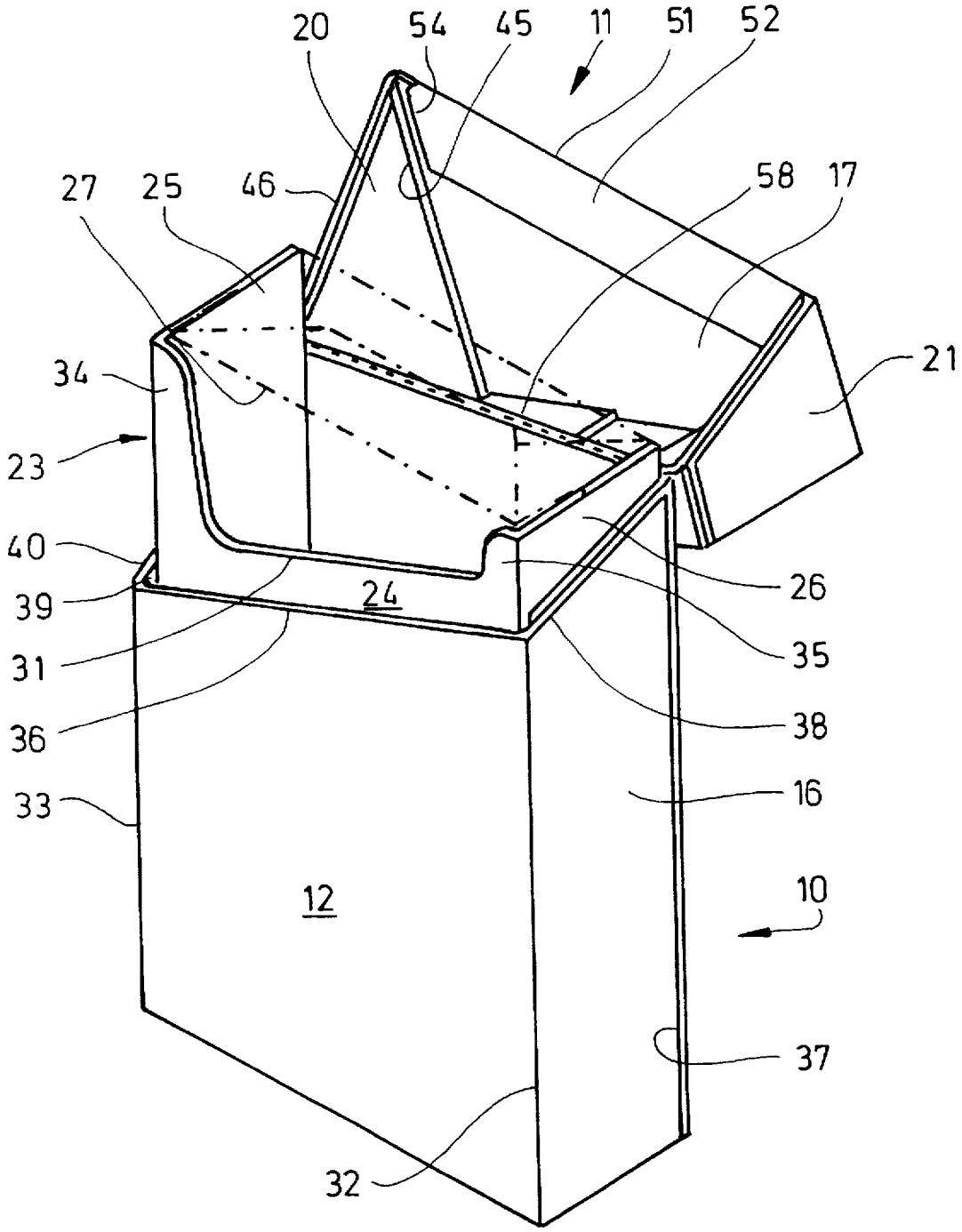
Figure 10:
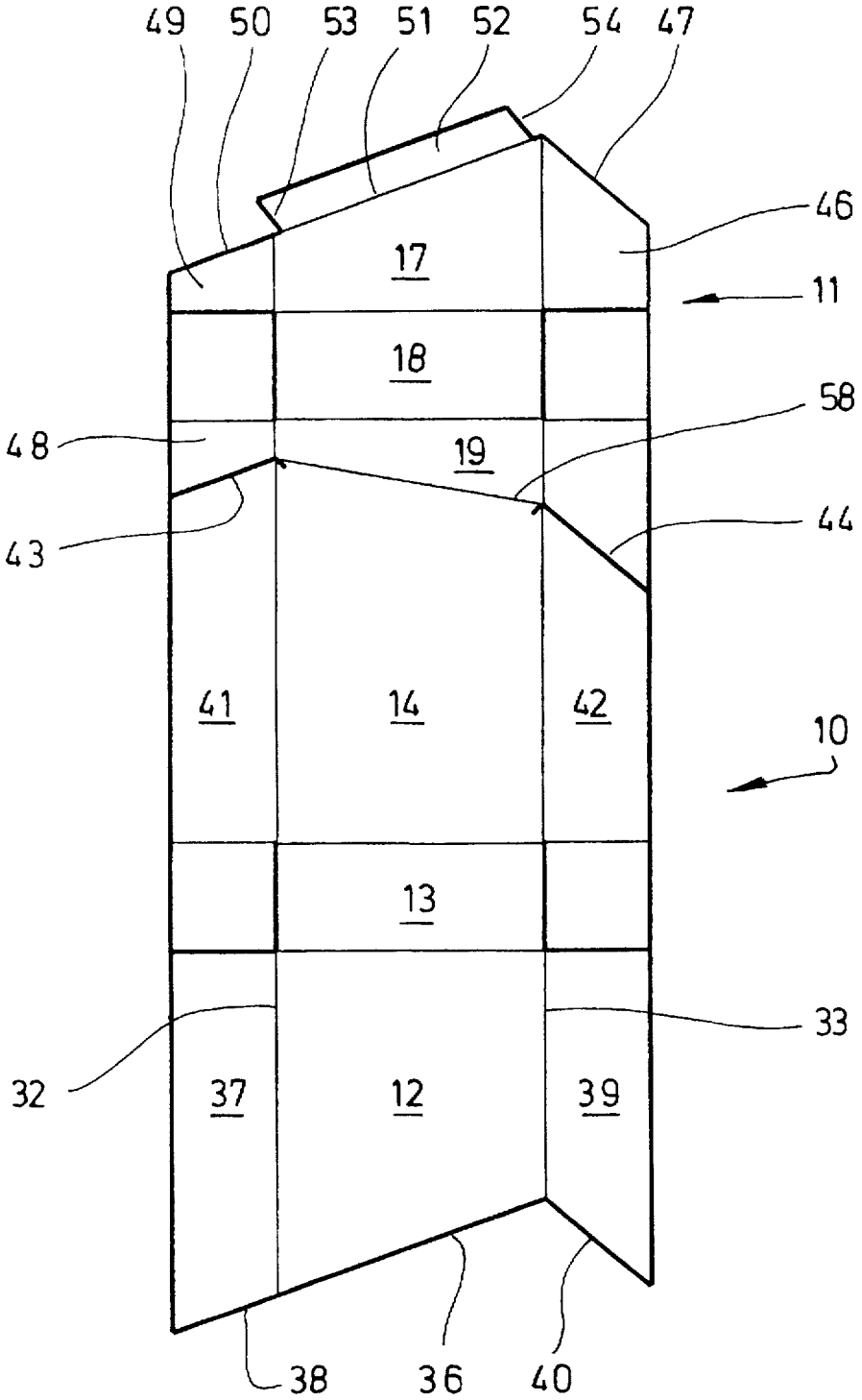

FIG. 6 a blank for an inner wrapping for a cigarette group,

FIG. 7 blank for a collar of the hinge-lid package,

FIG. 8 another construction of the hinge-lid package in a view corresponding to FIG. 1, FIG. 9 the hinge-lid package according to FIG. 8 in the open position analogous to FIGS. 2 and 4, and FIG. 10 a spread-out blank for the hinge-lid package according to FIGS. 8 and 9.

The illustrated examples of hinge-lid packages comprise in their basic construction a (lower) package portion 10 and an (upper) lid 11. These parts of the hinge-lid package consist of a common one-piece blank (FIG. 3, FIG. 5 and FIG. 10). The package portion 10 forms a package front wall 12, a base wall 13 connected thereto and, opposite the package front wall 12, a package rear wall 14. The package portion 10 is delimited at the sides by narrow, upright package side walls 15 and 16.

The lid 11 is formed in a similar way, i.e. with lid front wall 17, lid top wall 18, lid rear wall 19 and lid side walls 20, 21. Package portion 10 and lid 11 are flexibly interconnected in the region of the respective rear walls 14 and 19 by a transversely-oriented hinge joint 22. This is formed as a fold line in the one-piece blanks.

A collar 23 is positioned in the interior of the hinge-lid package. This collar is formed by a separate blank (FIG. 7). Collar 23 comprises a collar front wall 24 and collar side tabs 25, 26. The collar front wall 24 abuts with a lower partial area internally on the package front wall 12 and is connected thereto, for example by adhesive. The collar side tabs 25, 26 abut on the inner side of the package side walls 15, 16. An upper part portion of the collar 23 projects out of the package portion 10. The lid 11 surrounds this region of the collar 23 in the closed position. In the present embodiment the dimensions are so selected that the collar 23 extends roughly to below the lid upper wall 18.

Inside the hinge-lid package so formed there sits a block-shaped cigarette block 27. This is a cigarette group which is surrounded by an inner wrapping of paper or tinfoil. The cigarette block 27 fits at the top approximately flush with the collar 23.

The collar 23 is normally so shaped that an upwardly-open aperture 28 is formed in the region of the collar front wall 24. This aperture is intended to simplify removal of the cigarettes from the hinge-lid package or the package portion 10. When the package is used, for this purpose a flap 29 lying in the region of the front side is firstly separated from the inner wrapping (FIG. 6) of the cigarette block 27. The flap 29 is formed by transverse perforations 30 as a frontal portion of the inner wrapping (FIG. 4). When the flap 29 is removed the cigarettes are exposed in this area.

A particular feature of the present hinge-lid packages resides in the formation of the aperture 28. This latter is asymmetrical, i.e. delimited by an obliquely-extending lower collar edge 31. This latter extends at an angle to upright package edges 32, 33. With the rectilinear configuration of the collar edge 31 in the present case, the aperture 28 is given an approximately trapezoid shape. Thus this latter has a greater height on one side, on the left-hand front side in the present examples, so that a longer portion of the cigarettes is exposed. This simplifies removal of the cigarettes. The aperture 28 does not extend over the entire width of the collar front wall 24. Instead there are lateral, upright webs 34, 35 remaining in the region of the collar front wall 24. These webs, due to the shape of the aperture 28, have different heights.

A further, independent feature of the hinge-lid package consists in the fact that the package portion 10 is adapted to the shape of the aperture 28. An upper limit of the package front wall 12, i.e. a transversely-oriented package edge 36, is likewise obliquely oriented, i.e. at an angle to the package edges 32, 33. The configuration of the package edge 36 is in this case so selected that it is oriented parallel to the collar edge 31. Thus the package front wall 12 also receives a trapezoid shape.

A result of this formation of the package is that the package side walls 15, 16 have different heights. The package side wall 16 facing the longer or higher package edge 32 is higher than the opposite package side wall 15. The result of this again is that, in the region of the package side wall 15, the collar 23 projects with a larger portion of the collar side tab 25 and the connecting collar front wall 24 out of the package portion 10 than the opposite collar side tab 26.

The blank for the collar 23 is shown in an advantageous embodiment in FIG. 7. Corresponding with the approximately trapezoid aperture 28 in the collar front wall 24 is a projection 55 formed on the opposite or lower side. In this way the blank for the collar 23 can be separated from a continuous band of material without waste by means of transverse stamping cuts. The collar side tabs 25, 26 are delimited from the collar front wall 24 by perforated lines 56, 57.

In the region of the perforated lines 56, 57, the collar 23 has opening aids for the lid 11, so-called collar brakes 59, 60. The collar brakes 59, 60 are in this case of different lengths. The length of the collar brakes 59, 60 is adapted to the asymmetrical form of the aperture 28 or of the collar front wall 24. On the side of the hinge-lid package upon which, due to the asymmetrical form of the aperture 28, a longer portion of the cigarettes is exposed, the collar brake 59 is of greater length than on the opposite side of the hinge-lid package. This is constrained by the fact that in this region the web 34 of the collar front wall 24 projects out of the package portion 11 then the web 35 on the opposite side. This ensures that the lid 11 is secured against involuntary opening.

A further feature of the hinge-lid package resides in the formation of the inner wrapping of the cigarette block 27 according to FIG. 6. The perforation line 30 for delimiting the flap 29 is likewise obliquely oriented. The configuration of the perforation line 30 in this case is adapted to the configuration of the collar edge 31. The perforation line 30 and collar edge 21 preferably run parallel to one another.

The blank (FIG. 3) for such a hinge-lid package deviates in some respects from a standard hinge-lid package. In all the blank is elongate in shape. The walls of the package portion 10 and of the lid 11 are formed in succession, as for a blank for a previously-known hinge-lid package. One end of the blank is formed by the package edge 36, in this case obliquely oriented, i.e. at an angle to the fold lines for shaping the package edges 32, 33. In the present example the package edge 36 continues in the region of (externally-located) side tabs 37 as an outer layer of the two-layered side wall 16. The side tab 37 is here defined by an upper, oblique tab edge 38. On the opposite side of the package front wall 12 there is a side tab 39, which forms the outer layer in the package side wall 15. This side tab is defined by a tab edge 40 which is oriented at an obtuse angle to the package edge 36. The side tabs 37 on the one hand and 39 on the other hand are accordingly of different geometric shape.

Corresponding with this are internal side tabs 41, 42 which, together with the side tabs 37 on the one hand and 39 on the other hand form the package side walls 16 and 15. The said side tabs 41, 42 are, as normal, connected to the package rear wall 14 and delimited from fold tabs of the lid 11 by a stamped line 43 or 44. These are arranged at different angular positions so that the side tab 41 forms an edge which extends parallel to the tab edge 38. Similarly, the stamped line 44 is so arranged that an upper edge of the side tab 42 results, parallel to the tab edge 40.

The blank areas for the lid 11 are of a corresponding form. The lid side wall 20 is formed by two trapezoid lid side tabs 45 and 46. The outer lid side tab 46 is provided with a side edge 47 arranged at an extremely acute angle. An edge of the inner lid side tab 45, defined by the stamped line 44, fits against this.

The opposite lid side wall 21 consists of smaller lid side tabs 48 and 49. The outer lid side tab 49 is defined by a side edge 50 which in this case extends in extension of a likewise obliquely oriented lid edge 51. The lid edge 50 extends parallel to a corresponding edge of the inner lid side tab 48 in the region of the stamped line 43.

A further particular feature is the positioning and formation of a lid inner tab 52 (FIG. 3). This connects in one piece with the lid front wall 17 and, in the finished hinge-lid package, is folded inwards against the inner side of the lid front wall 17. The lid edge 51 is thus two-layered.

The lid inner tab 52 is in the form of an oblique-angled parallelogram. Side edges 53, 54 of the lid inner tab are oriented at an acute or obtuse angle to the lid edge 51. Due to this oblique positioning of the lid inner tab, there results a position such as is for example shown in FIG. 2, in which the side edges 53, 54 run parallel to the upright package edges 32, 33.

The hinge-lid package according to FIGS. 4 and 5 has a structure corresponding to the hinge-lid package according to FIGS. 2 and 3. It differs therefrom, however, in the formation of a lid inner tab 61. The lid inner tab 61 (FIG. 5) connected as one piece with the lid front wall 17. When folding of the hinge-lid package is complete, the lid inner tab is folded over inwards against the inner side of the lid front wall 17. Thus the lid edge 51 is two-layered.

The lid inner tab 61 is in the form of a right-angled triangle. Side edges 62, 63 of the lid inner tab 61 accordingly enclose an angle of approximately 90°. According to FIG. 5 the side edge 62 of the lid inner tab 61 extends roughly parallel to the fold edges of the blank forming the package edges 32,33. The side edge 63 of the lid inner tab 61 extends at right angles thereto, i.e. roughly parallel to a fold edge of the blank forming the hinge joint 22. In the finished hinge-lid package, and when the lid inner tab 61 is folded inwards, the side edges 62, 63 accordingly extend in accordance with FIG. 4 obliquely to the package edges 32, 33.

The hinge-lid package in the construction according to FIGS. 8 to 10 is regarded as particularly advantageous. Whereas in the embodiment previously described the linear hinge joint 22 extends in the previously-known way parallel to transverse edges of the hinge-lid package, in the embodiment in FIGS. 8 to 10 an oblique hinge joint 58 is provided.

The inclination of this hinge joint 58 corresponds to that of the package edge 36, thus in the present embodiment drops away from the right to the left. The angle of inclination of the hinge joint 58 is however slightly smaller than that of the package edge 36. A hinge-lid package so formed is particularly easy to open, even with one hand; the lid 11 can be actuated by the thumb in the region of the lid front wall 17 on the higher side of the lid 11.

The hinge joint 58 in this embodiment also extends between the mutually-facing ends of the stamped lines 43, 44. The stamped line 44 in this case lies deeper, i.e. with a smaller spacing from the base wall 13. In this case the stamped line 44 has a smaller inclination than in the embodiments in FIG. 3 and FIG. 5, with respect to the package edges 32, 33. For the shape of the associated side tabs 39 and 42 also and lid side tabs 45 and 46 there are corresponding geometric alterations with regard to the size and angular position of oblique edges. The lid rear wall in this arrangement of the hinge joint 58 is likewise given a trapezoid shape. Otherwise the shape of this hinge-lid package correspond s to that in FIGS. 1 to 7.

In the closed position, the package edge 36 and lid edge 51 abut on one another as, in the region of the package side walls 15, 16 and lid side walls 20, 21, the tab edges 38, 40 abut with the side edges 47, 50. In all the embodiments the collar 23 is of such dimensions and is so arranged within the package portion 10 that the collar edge 31 lies above the package edge 36.

The construction of the lid 11 with obliquely oriented hinge joint 58 can also be used independently of the shape and arrangement of the collar 23 or of the package front wall 12.

We claim:

1. A hinge-lid package for containing a cigarette group, in particular a cigarette block (27), surrounded by an inner wrapping, with a package portion (10) having a package front wall (12), a base wall (13), a package rear wall (14) and narrow package side walls (15, 16), with a lid (11) having a lid front wall (17), a lid top wall (18), a lid rear wall (19) as well as narrow lid side walls (20, 21) with the lid (11) and the package portion (10) being flexibly attached to a hinge joint (22, 58) which runs along the region of the package rear wall (14) and the lid rear wall, a collar (23), secured in and partially projecting from the package portion (10) having a collar front wall (24) and collar side tabs (25, 26), the collar front wall (24) having an upwardly-open aperture (28) in the region above the package front wall (12), characterized in that:

a) an aperture (28) of the collar front wall (24) is delimited by an oblique collar edge (31), with the collar edge (31) being adjacent to the package front wall (12), b) the aperture (28) has a greater height on one side, in the region of one package side wall (15), than on the opposite side, in the region of the second package side wall (16), c) a projection (55) of the collar front wall (24) opposite the aperture (28) likewise extends obliquely, parallel to the collar edge (31), d) the aperture (28) and the projection (55) have substantially similar geometric shapes and dimensions, e) the package front wall (12) has an upper limit at package edge (36) which extends obliquely, parallel to the collar edge (31), and said lid (11) is connected to the package rear wall (14) by an obliquely-extending hinge joint (58), with the hinge joint (58) having generally the same direction of inclination as the collar edge (31), but with a small angular deviation therefrom.

2. A blank made of thin cardboard or similar packaging material for a hinge-lid package for receiving a cigarette group surrounded by an inner wrapping, the package front wall (12), base wall (13), package rear wall (14), lid rear wall (19), lid to wall (18) and lid front wall (17), following one another in the longitudinal direction, are defined by fold lines, with a hinge joint (22, 58) located between the package rear wall (14) and lid rear wall (19), with side tabs (37, 39, 41, 42) arranged as a part of the package side wall (15, 16) on both sides of the package front wall (12) and on both sides of the package rear wall (14), and with lid side tabs (45, 46, 48, 49) arranged as a part of the lid side walls (20, 21) on both sides of the lid rear wall (19) and on both sides of the lid front wall (17), characterized in that:

a) the package front wall (12) is limited by an obliquely oriented package edge (36), b) the package edge (36) is continued in the region of one side tab (37), located adjacent to the package front wall (12), as a first tab edge (38), c) a second tab edge (40) of a second side tab (39), also located adjacent to the package front wall (12), is oriented at an obtuse angle to the package edge (36), d) the side tabs (41, 42) arranged adjacent to the package rear wall (14) are limited by stamped lines (43, 44) of the lid side tabs (45, 48) located adjacent to the lid rear wall (19), with the edges of the side tabs (41, 42), which are formed by the stamped lines (43, 44) being oriented parallel to each of the corresponding tab edges (38, 40), and said package rear wall (14) and lid rear wall (19) are connected by an obliquely-extending hinge joint (58), with said hinge joint (58) having a smaller angle of inclination than the package edge (36).

* * * * *